US010943757B2

(12) United States Patent
He et al.

(10) Patent No.: US 10,943,757 B2
(45) Date of Patent: Mar. 9, 2021

(54) GAS DISCHARGE TUBE

(71) Applicant: SHENZHEN BENCENT ELECTRONICS CO., LTD., Guangdong (CN)

(72) Inventors: Ji He, Guangdong (CN); Meng Fu, Guangdong (CN); Feilong Wang, Guangdong (CN)

(73) Assignee: SHENZHEN BENCENT TELECTRONICS CO., LTD., Guangdong (CN)

( * ) Notice: Subject to any disclaimer, the term of this patent is extended or adjusted under 35 U.S.C. 154(b) by 341 days.

(21) Appl. No.: 15/781,440

(22) PCT Filed: Jul. 5, 2016

(86) PCT No.: PCT/CN2016/088517

§ 371 (c)(1),
(2) Date: Jun. 4, 2018

(87) PCT Pub. No.: WO2017/092304

PCT Pub. Date: Jun. 8, 2017

(65) Prior Publication Data

US 2020/0279712 A1 Sep. 3, 2020

(30) Foreign Application Priority Data

Dec. 4, 2015 (CN) ..... 201510882495.0
Mar. 30, 2016 (CN) ..... 201610190179.X

(51) Int. Cl.
*H01J 17/18* (2012.01)
*H01J 9/26* (2006.01)
(Continued)

(52) U.S. Cl.
CPC ..... *H01J 17/186* (2013.01); *H01J 9/265* (2013.01); *H01J 17/04* (2013.01); *H01J 17/16* (2013.01);
(Continued)

(58) Field of Classification Search
None
See application file for complete search history.

(56) References Cited

U.S. PATENT DOCUMENTS 2,370,082 A * 2/1945 Slepian ..... H01T 4/16 361/120
4,282,557 A 8/1981 Stetson
(Continued)

FOREIGN PATENT DOCUMENTS

CN 1873884 A 12/2006
CN 101868889 10/2010
(Continued)

OTHER PUBLICATIONS

European Search Report issued in PCT/CN2016088517 dated Jul. 10, 2019.

*Primary Examiner* — Ashok Patel
(74) *Attorney, Agent, or Firm* — Workman Nydegger

(57) ABSTRACT

Provided is a gas discharge tube, including at least two electrodes and an insulating tube body, which is connected in a sealing manner with the electrodes to form a discharge inner cavity. A low-temperature sealing adhesive for sealing the discharge inner cavity is arranged in the gas discharge tube. The low-temperature sealing adhesive is melted at a specific low temperature to cause gas leakage in the discharge inner cavity.

12 Claims, 10 Drawing Sheets

(51) Int. Cl.

| | |
|---|---|
| ***H01J 17/04*** | (2012.01) |
| ***H01J 17/16*** | (2012.01) |
| ***H01J 61/30*** | (2006.01) |
| ***H01T 1/15*** | (2006.01) |
| ***H01T 4/12*** | (2006.01) |

(52) U.S. Cl.
CPC ..... *H01J 61/30* (2013.01); *H01T 1/15* (2013.01); *H01T 4/12* (2013.01)

(56) References Cited

U.S. PATENT DOCUMENTS

| | | | | |
|---|---|---|---|---|
| 2005/0189877 | A1* | 9/2005 | Ishida | H01J 9/266 313/512 |
| 2006/0261720 | A1* | 11/2006 | Oran | H01J 61/305 313/318.01 |
| 2010/0265627 | A1 | 10/2010 | Morczinek et al. | |
| 2016/0049276 | A1* | 2/2016 | Fu | H01J 9/02 313/581 |

FOREIGN PATENT DOCUMENTS

| | | |
|---|---|---|
| CN | 105374653 | 2/2016 |
| CN | 205177764 | 4/2016 |
| CN | 105610049 | 5/2016 |
| EP | 0040522 | 11/1981 |
| GB | 596083 | 12/1947 |
| JP | H0439881 | 2/1992 |
| JP | H0765930 | 3/1995 |
| JP | 2001189185 | 7/2001 |
| JP | 2007242242 | 9/2007 |
| JP | 2011504281 | 2/2011 |
| JP | H06124687 | 5/2016 |
| KR | 20060116172 | 11/2006 |
| KR | 20100094531 | 8/2010 |

* cited by examiner

GAS DISCHARGE TUBE

TECHNICAL FIELD

The present disclosure relates to the field of overvoltage protection products, more particularly to a gas discharge tube.

BACKGROUND

A gas discharge tube is a switch type protective device and commonly serves as an overvoltage protective device. At present, the generally-used gas discharge tube is formed by connecting electrodes to both ends of an insulating tube body in a sealing manner and filling an inner cavity with an inert gas. When the voltage between the electrodes of the gas discharge tube exceeds a breakdown voltage of the gas, gap discharging will be caused. Then the gas discharge tube quickly changes from a high impedance state into a low impedance state to breakover, thereby protecting other devices connected in parallel with the gas discharge tube.

However, meanwhile, the gas discharge tube may be heated and have a temperature rise due to long-time or frequent overcurrent if the overvoltage lasts for a long time or occurs frequently, or a power frequency overcurrent occurs for a long time or is large. An extremely high temperature not only affects the safe use of other devices in the circuit, but also causes a risk of short circuit or explosion of the gas discharge tube, and even burns out a circuit board of a customer, resulting in a fire.

SUMMARY

The present disclosure aims to provide a gas discharge tube capable of providing effective overvoltage protection for a circuit and forming an open circuit during temperature rise caused by overcurrent to cut off the circuit timely.

In view of this, embodiments of the present disclosure provide a gas discharge tube, which includes at least two electrodes and an insulating tube body which is connected in a sealing manner with the electrodes to form a discharge inner cavity. A low-temperature sealing adhesive for sealing the discharge inner cavity is arranged in the gas discharge tube. The low-temperature sealing adhesive is melted at a specific low temperature to cause gas leakage in the discharge inner cavity.

Further, at least one electrode of the electrodes is provided with an axial ventilation hole. The axial ventilation hole has an inner end connected with the discharge inner cavity and an outer end connected with a cover plate through the low-temperature sealing adhesive.

Further, at least one electrode of the electrodes is provided with a radial ventilation hole. At least one end of the radial ventilation hole is connected with the discharge inner cavity. The radial ventilation hole penetrate through a groove in an outer surface of the electrode. A cover plate for covering the groove is arranged on the groove. The cover plate is connected to the outer surface of the electrode through the low-temperature sealing adhesive.

Further, the insulating tube body is provided with a ventilation hole. The ventilation hole has an outer end connected with a cover plate through the low-temperature sealing adhesive.

Further, the insulating tube body is provided with a disconnection layer for dividing the insulating tube body into two sections along a radial direction. The low-temperature sealing adhesive is arranged on the disconnection layer and connects in the sealing manner the two sections of the insulating tube body.

Further, the gas discharge tube includes a middle electrode. The middle electrode is provided with a disconnection layer for dividing the middle electrode into two portions. The low-temperature sealing adhesive is arranged in the disconnection layer and connects in the sealing manner the two portions of the middle electrode.

Further, at least one electrode of the electrodes is connected in the sealing manner with the insulating tube body through the low-temperature sealing adhesive.

Further, the at least one electrode is connected in the sealing manner with the insulating tube body through the low-temperature sealing adhesive in a following manner: a metalized layer or a metal ring is arranged between the electrode and the insulating tube body, and the electrode is connected in the sealing manner with the metalized layer or the metal ring through the low-temperature sealing adhesive.

Further, the gas discharge tube further includes a spring apparatus. The spring apparatus has at least one free end. The free end is pressed into a retracted state by the electrode adhered with the low-temperature sealing adhesive. When the low-temperature sealing adhesive is melted, a counter-force of the free end to the electrode is greater than an adhesive force between the electrode and the low-temperature sealing adhesive, and the free end extends to pull away the electrode adhered with the low-temperature sealing adhesive.

Further, the gas discharge tube further includes pins and a shell. The pins are connected with the electrodes respectively. The shell having a cavity for accommodating the spring apparatus. The cavity is further provided with a through hole communicated with external air. At least one pin of the pins extends out via the through hole.

Further, the low-temperature sealing adhesive has a specific shape, so that the low-temperature sealing adhesive meets a specific melting requirement.

Further, at least one leakage-prone point is arranged on the electrodes or the low-temperature sealing adhesive or the insulating tube body, so that the low-temperature sealing adhesive is easier to melt at the leakage-prone point relative to other positions.

Further, the discharge inner cavity is filled with insulating particulate matter.

Further, a protective layer having a heat conductivity coefficient less than the heat conductivity coefficient of the electrodes is arranged on an outer surface in contact with the outside of the low-temperature sealing adhesive.

Further, the protective layer is a nickel layer, a chromium layer, a layer of any other metal or a layer of non-metal.

The gas discharge tube provided by embodiments of the present disclosure may implement overvoltage protection when undergoing a lightning overvoltage. Furthermore, under extremely large current or the long-time overcurrent, when the low-temperature sealing adhesive has a temperature rise and is melted due to heat emission, the gas discharge tube may leak the gas to cause the open circuit, thereby cutting off the overcurrent. The gas discharge tube has good performance of overvoltage and overcurrent protection.

BRIEF DESCRIPTION OF DRAWINGS

In order to make the embodiments of the present application or the technical scheme in the prior art more clear, drawings to be used in the embodiments or the prior art will be briefly described below. Apparently, the drawings in the following description are only some embodiments of the present application. Those ordinarily skilled in the art can also obtain other drawings according to these drawings without contributing creative work.

DETAILED DESCRIPTION

Most Preferred Embodiment of the Disclosure

Most Preferred Implementation of the Disclosure

Figure 8:
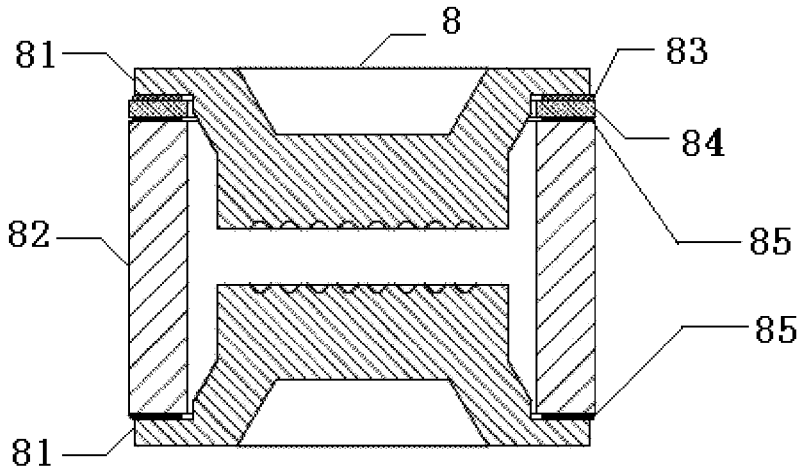
FIG. 8 is an axially sectional view illustrating a gas discharge tube provided by Embodiment 8 of the present disclosure.
Figure 12:
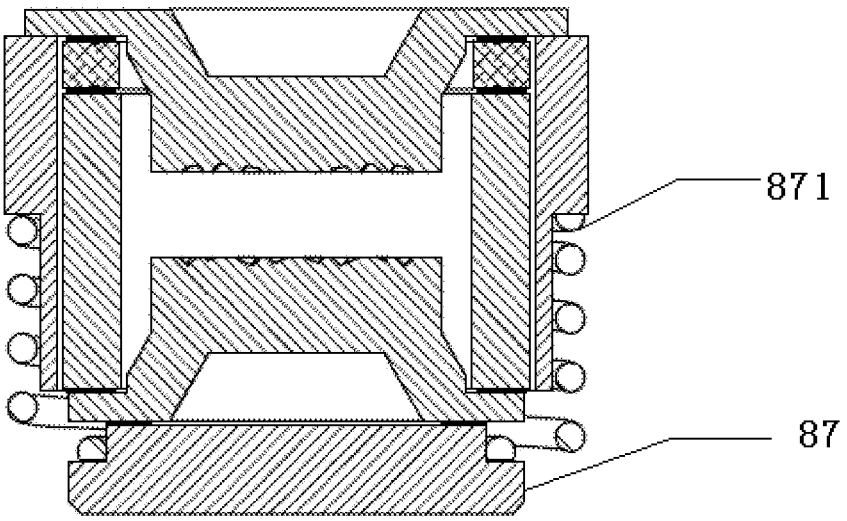
FIG. 12 is an axially sectional view illustrating a gas discharge tube according to a second preferred implementation provided by Embodiment 8 of the present disclosure.

FIG. 12 is an axially sectional view illustrating a gas discharge tube according to a most preferred embodiment of the present disclosure. With reference to FIG. 12, the gas discharge tube shown in FIG. 12 is the same as the gas discharge tube shown in FIG. 8 in the following aspects: electrodes, an insulating tube body, a low-temperature sealing adhesive, a metal ring and a high-temperature solder layer. A difference from the gas discharge tube shown in FIG. 8 is that: the gas discharge tube shown in FIG. 12 further includes a spring apparatus 87. The spring apparatus 87 has a free end 871. The free end 871 is pressed into a retracted state by the electrode adhered with the low-temperature sealing adhesive. When the low-temperature sealing adhesive is melted, a counterforce of the free end 871 to the electrode is greater than an adhesive force between the electrode and the low-temperature sealing adhesive, so that the free end 871 extends to pull away the electrode adhered with the low-temperature sealing adhesive. Similarly, when both ends of the gas discharge tube are provided with the low-temperature sealing adhesives, the spring apparatus may be provided with two free ends (not shown). Any one of the free ends may extend to pull away the electrode at the end as long as the low-temperature sealing adhesive at the end is melted. The present embodiment has the advantages as follows. When a large current passes through the gas discharge tube, if the low-temperature sealing adhesive starts to be melted and the adhesive force between the low-temperature sealing adhesive and the electrode is reduced, the equilibrium between the counterforce and the adhesive force is broken and the spring apparatus enables the free end to extend to quickly pull away the electrode adhered with the low-temperature sealing adhesive. This results in quick gas leakage and causes an open circuit, so as to further enhance the open circuit protection for a circuit. On the contrary, if no spring apparatus is provided, when the large current passes through the gas discharge tube, instantaneous discharging generates extremely large quantity of heat, which may possibly cause such a phenomenon that the electrode is melted and explodes and sputters before the low-temperature sealing adhesive is melted to leak gas, thereby resulting in a short circuit.

Embodiments of the Disclosure

Implementations of the Disclosure

The present disclosure will be further described below by using the following embodiments in combination with the drawings. It should be noted in advance that a high-temperature solder of the present disclosure refers to a solder having a melt point higher than 500° C. The high temperature refers to a temperature higher than 500° C. The low temperature of the present disclosure refers to a relatively low temperature relative to the high temperature and is 500° C. or below. The low-temperature sealing adhesive of the present disclosure refers to a sealing material capable of resisting the low temperature. This material may be melted to deform and even be liquefied in an environment with a temperature higher than the low temperature, resulting in a sealing failure. The insulating tube body of the present disclosure refers to a glass tube, a ceramic tube or insulating tube bodies made of other materials suitable for being used as the gas discharge tube. The gas discharge tube of the present disclosure includes a diode, a triode and a multi electrode tube.

Figure 1:
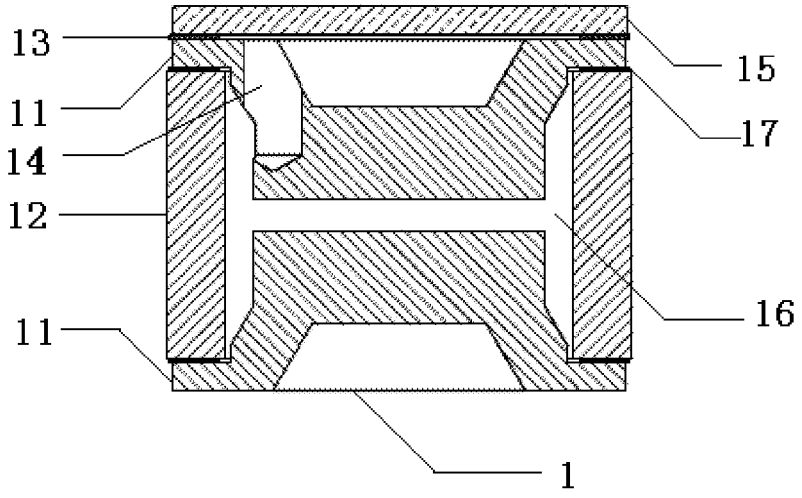
FIG. 1 is an axially sectional view illustrating a gas discharge tube provided by Embodiment 1 of the present disclosure.

With reference to FIG. 1, an axially sectional view illustrating a gas discharge tube provided by Embodiment 1 of the present disclosure is shown. As shown in FIG. 1, the gas discharge tube 1 of the present embodiment includes: electrodes 11, an insulating tube body 12, a low-temperature sealing adhesive 13, a ventilation hole 14 and a cover plate 15. The electrodes 11 are connected in the sealing manner with the insulating tube body 12 to form a discharge inner cavity 16. The ventilation hole 14 is axially formed in the electrodes 11. The inner end of the ventilation hole 14 is connected with the discharge inner cavity 16, and the outer end of the ventilation hole 14 is connected with the cover plate 15 through the low-temperature sealing adhesive 13.

Specifically, the electrodes 11 and the insulating tube body 12 are sealed by adopting a high-temperature solder 17. Preferably, the high-temperature solder 17 is the silver-copper solder.

Specifically, the low-temperature sealing adhesive 13 is a low-temperature solder or a low-temperature adhesive. Preferably, the low-temperature solder is a low-temperature tin solder or glass solder, and has a melt point of about 350° C. The low-temperature adhesive is an organic adhesive such as glue.

In a preferred embodiment, a plurality of ventilation holes 14 are provided, which are all arranged on one electrode. In another preferred embodiment, a plurality of ventilation holes 14 are provided, which are arranged on the electrodes respectively.

In another preferred embodiment, the cover plate 15 is a cover plate having a rough surface or a cover plate with a ventilation trench, so as to increase an adhesive force of the low-temperature sealing adhesive 13 on the cover plate 15 and to achieve better sealing effect. Meanwhile, when the low-temperature sealing adhesive 13 is melted, gas in the discharge inner cavity 16 is easier to leak through the cover plate having the rough surface or the cover plate with the ventilation trench, so that a subsequent circuit is cut off quickly.

The present embodiment has the advantages described below.

The ventilation hole for connecting the discharge inner cavity with the outside is formed in the gas discharge tube, and the low-temperature sealing adhesive is arranged at the outer end of the ventilating hole. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the ventilation hole, and external air enters the discharge inner cavity of the gas discharge tube, thereby quickly cutting off the circuit and protecting the circuit.

Figure 2:
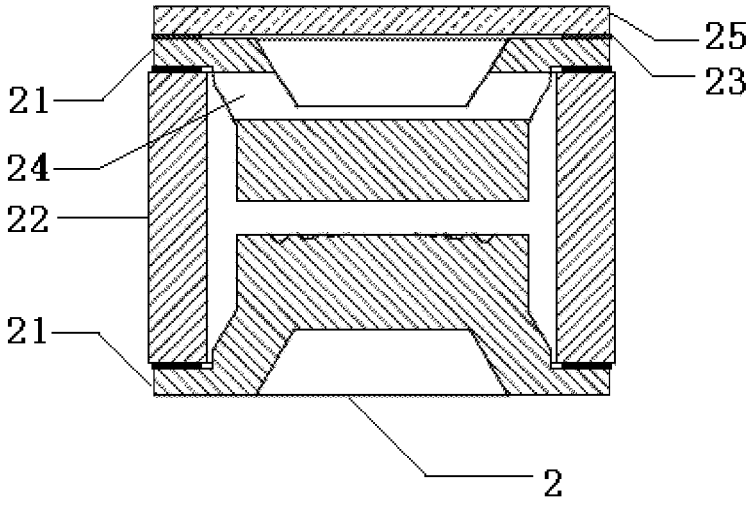
FIG. 2 is an axially sectional view illustrating a gas discharge tube provided by Embodiment 2 of the present disclosure.

With reference to FIG. 2, an axially sectional view illustrating a gas discharge tube provided by Embodiment 2 of the present disclosure is shown. As shown in FIG. 2, the gas discharge tube 2 of the present embodiment includes: electrodes 21, an insulating tube body 22, a low-temperature sealing adhesive 23, a ventilation hole 24 and a cover plate 25. A difference from the embodiment shown in FIG. 1 is that the ventilation hole 24 in the present embodiment is disposed in a radial direction. One end of the radial ventilation hole 24, or the left and right ends of the radial ventilation hole 24, is connected to the discharge inner cavity. The radial ventilation hole 24 penetrates through a groove in the outer surface of one of the electrodes 21. The cover plate 25 for covering the groove is arranged on the groove. The cover plate 25 is connected to the outer surface of the electrode 21 through the low-temperature sealing adhesive 23. All other components are the same as those in the embodiment shown in FIG. 1, so that no more details will be described herein.

The present embodiment has the advantages described below.

The ventilation hole for connecting the discharge inner cavity with the outside is formed in the gas discharge tube, and the low-temperature sealing adhesive is arranged at the outer end of the ventilating hole. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the ventilation hole, and external air enters the discharge inner cavity of the gas discharge tube, thereby quickly cutting off the circuit and protecting the circuit.

Figure 3:
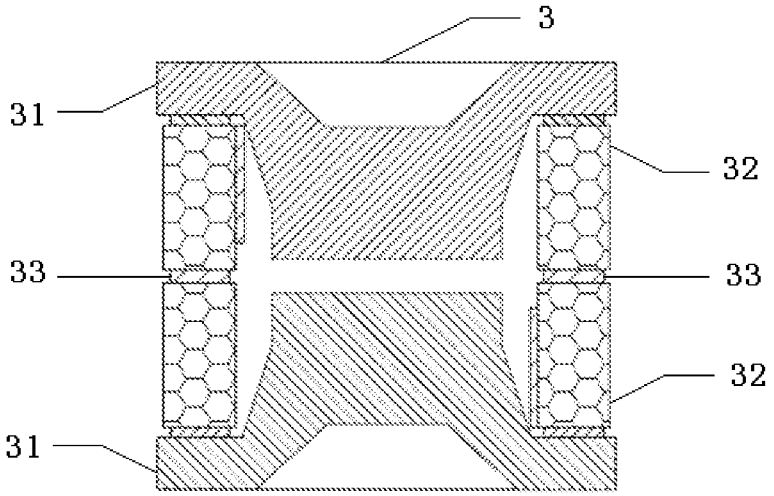
FIG. 3 is an axially sectional view illustrating a gas discharge tube provided by Embodiment 3 of the present disclosure.

With reference to FIG. 3, an axially sectional view illustrating a gas discharge tube provided by Embodiment 3 of the present disclosure is shown. As shown in FIG. 3, the gas discharge tube 3 of the present embodiment includes: electrodes 31, an insulating tube body 32 and a low-temperature sealing adhesive 33.

Specifically, a disconnection layer is arranged in the middle of the insulating tube body 32, so that the insulating tube body is divided into two sections along a radial direction. The low-temperature sealing adhesive 33 is arranged on the disconnection layer and connects in the sealing manner the two sections of the insulating tube body. Of course, it also can be understood that the two sections of the insulating tube body 32 are connected together in the sealing manner through the low-temperature sealing adhesive 33, so that the effect and the principle are the same as those in the present embodiment 3.

In a preferred embodiment, the low-temperature sealing adhesive 33 is arranged in the middle of the disconnection layer, so that in case of a power frequency current, it is easier to absorb the heat generated by the discharge tube during continuous arc discharging and it is easier to occur a failure of open circuit caused by gas leakage, thereby cutting off a circuit.

As another variation of the present embodiment, a ventilation hole (not shown) also may be provided in the insulating tube body 32. The outer end of this ventilation hole is connected in the sealing manner with the cover plate through the low-temperature sealing adhesive, so that the effect and the principle are still the same as those of the present embodiment 3.

The present embodiment has the advantages described below.

The disconnection layer is provided in the insulating tube body of the gas discharge tube and is sealed through the low-temperature sealing adhesive. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the disconnection layer, and external air enters the discharge inner cavity of the gas discharge tube, thereby quickly cutting off the circuit and protecting the circuit.

Figure 4:
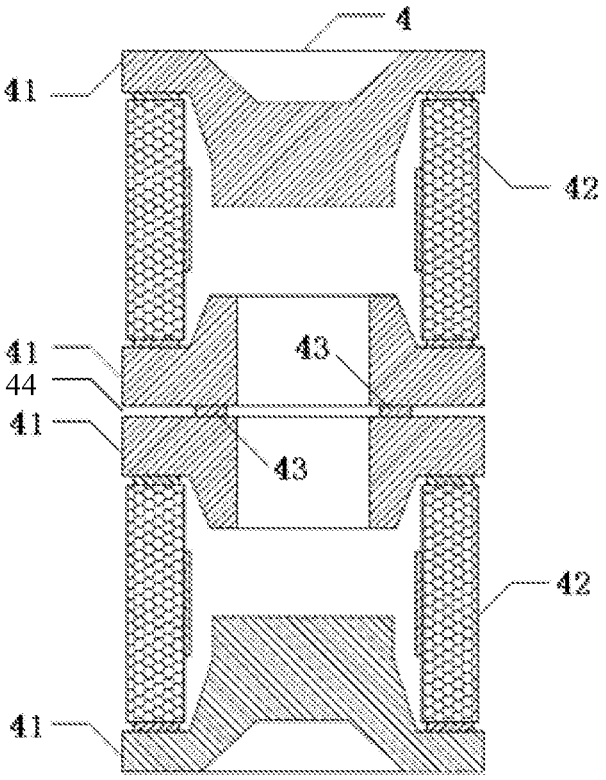
FIG. 4 is an axially sectional view illustrating a gas discharge tube provided by Embodiment 4 of the present disclosure.

With reference to FIG. 4, an axially sectional view illustrating a gas discharge tube provided by Embodiment 4 of the present disclosure is shown. As shown in FIG. 4, the gas discharge tube 4 of the present embodiment includes: electrodes 41, an insulating tube body 42 and a low-temperature sealing adhesive 43.

Specifically, the gas discharge tube 4 of the present embodiment is a triode, including an upper electrode, a lower electrode and a middle electrode.

The middle electrode 41 of the gas discharge tube 4 is provided with a disconnection layer 44 for dividing the middle electrode 41 into two portions. The low-temperature sealing adhesive 43 is arranged in the disconnection layer and connects in the sealing manner the two separated portions of the middle electrode 41.

The present embodiment has the advantages described below.

The disconnection layer is provided in the insulating tube body of the gas discharge tube and is sealed through the low-temperature sealing adhesive. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the disconnection layer, and external air enters the discharge inner cavity of the gas discharge tube, thereby quickly cutting off the circuit and protecting the circuit.

Figure 5:
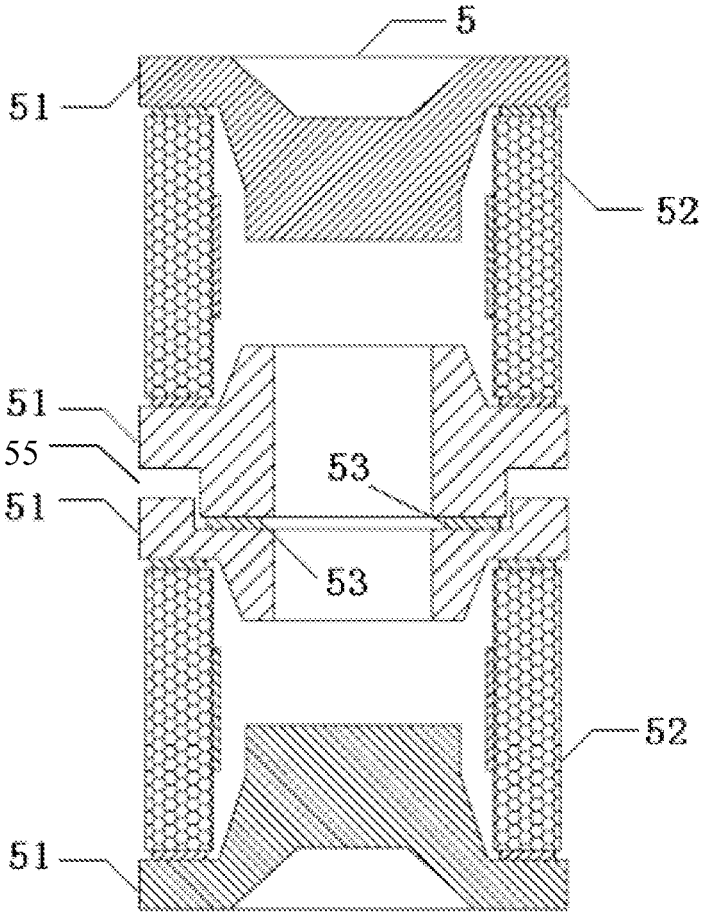
FIG. 5 is an axially sectional view illustrating a gas discharge tube provided by Embodiment 5 of the present disclosure.

With reference to FIG. 5, an axially sectional view illustrating a gas discharge tube provided by Embodiment 5 of the present disclosure is shown. As shown in FIG. 5, the gas discharge tube 5 of the present embodiment includes: electrodes 51, an insulating tube body 52 and a low-temperature sealing adhesive 53.

A difference from the embodiment shown in FIG. 4 is that the disconnection layer 54 of the middle electrode 51 in the present embodiment has a shape of a broken line opening, but the disconnection layer in the embodiment shown in FIG. 4 has a shape of a straight line opening. The low-temperature sealing adhesive 53 is arranged on a cross section linearly connected with the discharge inner cavity. All other components are the same as those in the embodiment shown in FIG. 4, so that no more details will be described herein.

The present embodiment has the advantages described below.

The broken line opening-shaped disconnection layer is arranged in the middle electrode of the gas discharge tube, and the low-temperature sealing adhesive is used to seal the end of the middle electrode linearly connected with the discharge inner cavity. Therefore, during the reflow soldering of the product, the low-temperature sealing adhesive is not in direct contact with a tin solder layer of an surface-mounted outer electrode, and the opening has a heat dissipation effect. Therefore, during reflow soldering, the low-temperature sealing adhesive is difficult to overheat and damage, and gas leakage does not occur. However, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the disconnection layer, and external air enters the discharge inner cavity of the gas discharge tube, thereby quickly cutting off the circuit and protecting the circuit.

Figure 6:
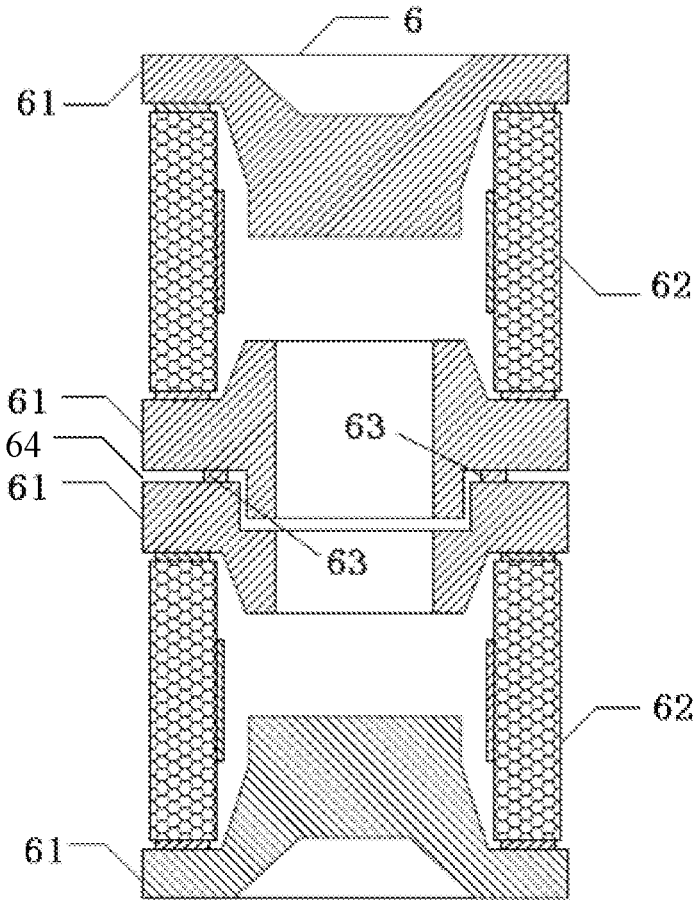
FIG. 6 is an axially sectional view illustrating a gas discharge tube provided by Embodiment 6 of the present disclosure.

With reference to FIG. 6, an axially sectional view of a gas discharge tube provided by Embodiment 6 of the present disclosure is shown. As shown in FIG. 6, the gas discharge tube 6 of the present embodiment includes: electrodes 61, an insulating tube body 62 and a low-temperature sealing adhesive 63. The disconnection layer 64 of the middle electrode 61 in the present embodiment also has the shape of a broken line opening.

A difference from the embodiment shown in FIG. 5 is that the low-temperature sealing adhesive 63 in the present embodiment is arranged on a cross section linearly connected with the exterior of the gas discharge tube. All other components are the same as those in the embodiment shown in FIG. 5, so that no more details will be described herein.

The present embodiment has the advantages described below.

The broken line-shaped disconnection layer is arranged in the middle electrode of the gas discharge tube, and the low-temperature sealing adhesive is used to seal the end of the middle electrode linearly connected with the exterior of the gas discharge tube, achieving a good sealing effect. The low-temperature sealing adhesive absorbs heat relatively slowly and is difficult to melt and is thus suitable for occasions requiring a relatively low melting speed. The gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak through the disconnection layer, and external air enters the discharge inner cavity of the gas discharge tube, thereby quickly cutting off the circuit and protecting the circuit.

Figure 7:
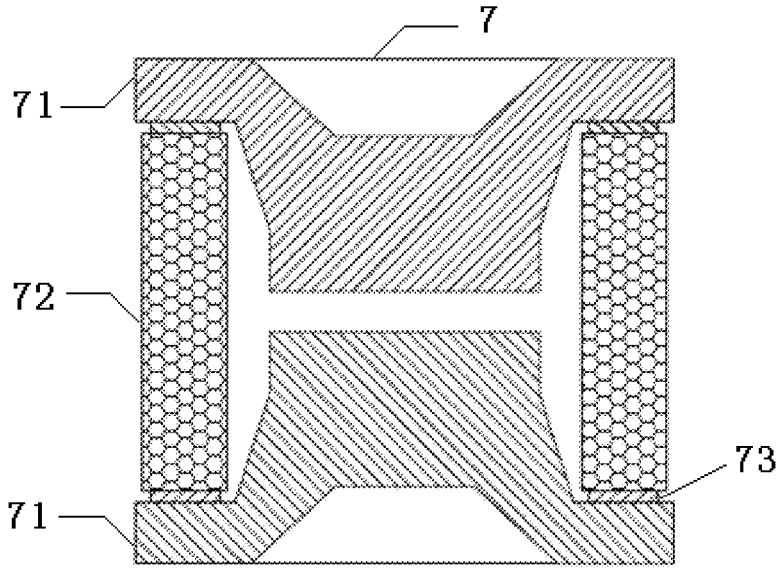
FIG. 7 is an axially sectional view illustrating a gas discharge tube provided by Embodiment 7 of the present disclosure.

With reference to FIG. 7, an axially sectional view illustrating a gas discharge tube provided by Embodiment 7 of the present disclosure is shown. As shown in FIG. 7, the gas discharge tube 7 of the present embodiment includes: electrodes 71, an insulating tube body 72 and low-temperature sealing adhesives 73.

Specifically, the insulating tube body 72 has an upper end and a lower end which are respectively called a first end and a second end. The first end of the insulating tube body 72 and the electrodes 71 are sealed through the low-temperature sealing adhesive 73.

In a preferred embodiment, the first end of the insulating tube body 72 is a metalized layer, and the low-temperature sealing adhesive 73 is a low-temperature solder. Preferably, the metalized layer is a molybdenum and manganese layer and is one-layer or multi-layer. Preferably, the low-temperature solder is a low-temperature tin solder.

In another preferred embodiment, the first end of the insulating tube body 72 is ceramic whiteware, and the low-temperature sealing adhesive 73 is a low-temperature adhesive. Preferably, the low-temperature adhesive 73 is an organic adhesive such as glue.

In a preferred embodiment, the second end of the insulating tube body 72 and the electrode 71 are sealed through the low-temperature sealing adhesive 73.

Specifically, the second port is a metalized layer or ceramic whiteware. When the second end is the metalized layer, the low-temperature sealing adhesive is a low-temperature solder. When the second end is the ceramic whiteware, the low-temperature sealing adhesive is a low-temperature adhesive.

In a preferred embodiment, the adhesion area between the insulating tube body 72 and the electrodes 71 is set, so that the low-temperature sealing adhesives 73 meets a specific melting requirement. Specifically, the specific melting requirement is as follows: in an actual circuit, a melting speed of the low-temperature sealing adhesive 73 is set according to a circuit use environment and the high-temperature resistance performance of a device to be protected. For example, if the normal working temperature of a circuit is 0 to 350° C., and a certain electronic device to be protected may resist the highest temperature of 370° C. for 30 seconds, the low-temperature sealing adhesive 73 is required to meet the specific melting requirement as follows: the low-temperature sealing adhesive 73 is not melted at a temperature comprised between 0 and 350° C., start to be melted at a temperature comprised between 350 and 370° C., and has to be melted within 25 seconds at the temperature of 370° C., so that the gas discharge tube leaks gas to cut off the circuit to protect the electronic device.

Preferably, the adhesion area between the insulating tube body 72 and the electrodes 71 may set in four approaches describe below.

In an approach 1, a radial width of the insulating tube body 72 is set to a specific width to enable the contact area between the insulating tube body 72 and the low-temperature sealing adhesive 73 to be a specific area, so as to facilitate the control of the melting speed of the low-temperature sealing adhesive 73.

In an approach 2, protrusions having a specific width are arranged at the end of the insulating tube body 72, which is sealed through the low-temperature sealing adhesive 73, and are adhered with the low-temperature sealing adhesive 73, so as to facilitate the control of the melting speed of the low-temperature sealing adhesive 73.

In an approach 3, the low-temperature sealing adhesive 73 is set to have a specific width, so as to facilitate the control of the melting speed of the low-temperature sealing adhesive 73.

In an approach 4, protrusions having a specific width are arranged on the inner surface of the electrode 71, which is in contact with the low-temperature sealing adhesive 73, and are adhered with the low-temperature sealing adhesive 73, so as to facilitate the melting speed of the low-temperature sealing adhesive 73.

Figure 10:
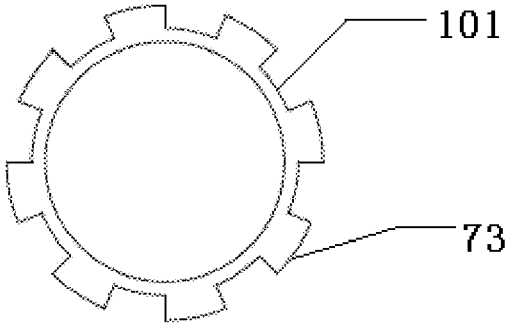
FIG. 10 is a cross sectional view illustrating a low-temperature sealing adhesive of a gas discharge tube provided by Embodiment 7 of the present disclosure.

Preferably, leakage-prone points are arranged on the electrodes 71, and/or the low-temperature sealing adhesive 73, and/or the ends of the insulating tube body 72, and the adhesion area between the insulating tube 72 and the electrodes 71 at the leakage-prone points is smaller than that at other positions. One or more leakage-prone points may be arranged. Specifically, with reference to FIG. 10, an axially sectional view illustrating the low-temperature sealing adhesive 73 of the gas discharge tube provided by the present embodiment is shown. Multiple leakage-prone points 101 are provided in the figure.

Specifically, the leakage-prone points 101 are positions where the low-temperature sealing adhesive 73 is prone to melt due to the least adhesive force and the least material. The melting causes the gas discharge tube to leak gas to cut off the circuit.

The present embodiment has the advantages described below.

The ends of the insulating tube body of the present embodiment are sealed through the low-temperature sealing adhesive. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak from the discharge inner cavity, and external air enters the discharge inner cavity of the gas discharge tube, thereby quickly cutting off the circuit and protecting the circuit.

Further, the present disclosure provides the following two preferred implementations as preferred implementations of Embodiment 7.

Figure 16:
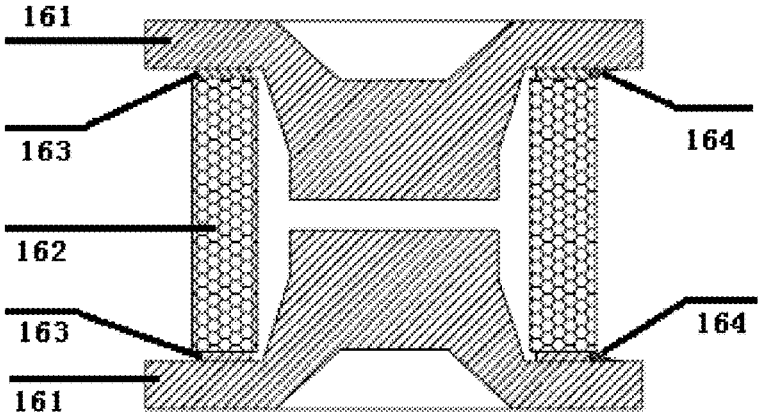
FIG. 16 is an axially sectional view illustrating a gas discharge tube according to a first preferred implementation provided by Embodiment 7 of the present disclosure.

With reference to FIG. 16, an axially sectional view illustrating a gas discharge tube according to a first preferred implementation provided by Embodiment 7 of the present disclosure is shown. The present embodiment is the same as the embodiment as shown in FIG. 7 in the following aspects: electrodes 161 and an insulating tube body 162, and that the electrodes 161 and the insulating tube body 162 are sealed by adopting low-temperature sealing adhesive 163. A difference is that: a protective layer 164 having a heat conductivity coefficient less than that of the electrodes is arranged on the outer surface of the low-temperature sealing adhesive 163 on one side of the gas discharge tube. Specifically, the protective layer is a nickel layer, a chromium layer, a layer of other metals or a layer of non-metal, and is arranged on the outer surface of the low-temperature sealing adhesive 163 in an electroplating or powdering manner. This has the benefits described below. Firstly, when the gas discharge tube is subjected to surface-mounted reflow soldering by a user, a small part of external heat may be transferred to the low-temperature sealing adhesive 163 because the heat conductivity coefficient of the protective layer is small, so as to prevent a failure, caused by a misoperation of open circuit, of the gas discharge tube during the reflow soldering. Secondly, when the gas discharge tube is heated by a large current or a long-time overcurrent, a little part of the heat inside the gas discharge tube is transferred to the outside because the small heat conductivity coefficient is small, and the heat may be more intensively used to melt the low-temperature sealing adhesive, so that the gas discharge tube is enabled to have an open circuit quickly.

Figure 17:
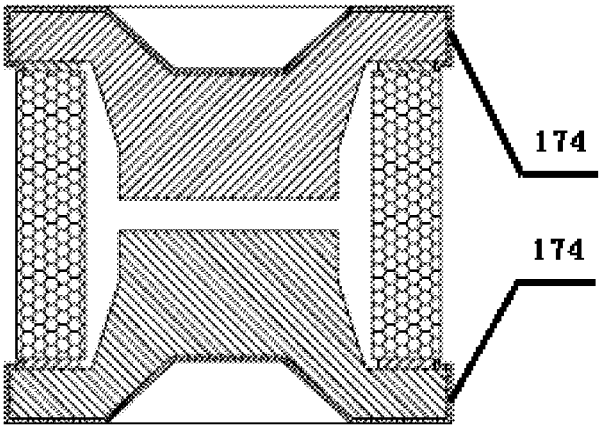
FIG. 17 is an axially sectional view illustrating a gas discharge tube according to a second preferred implementation provided by Embodiment 7 of the present disclosure.

With reference to FIG. 17, an axially sectional view illustrating a gas discharge tube according to a second preferred implementation provided by Embodiment 7 of the present disclosure is shown.

A difference between the present embodiment and the embodiment shown in FIG. 16 is that: protective layers 174 are arranged on all the outer surfaces of the gas discharge tube except the outer surface of the insulating tube body, i.e., the protective layers 174 are arranged on the outer surfaces of the electrodes and the low-temperature sealing adhesive. The heat conductivity coefficient of the protective layers 174 is less than that of the electrodes, so that the heat transferring is relatively slow. Specifically, the protective layers are nickel layers, chromium layers, layers of other metals or layers of non-metal, and are arranged on the outer surfaces of the electrodes and the low-temperature sealing adhesive in an electroplating or powdering manner. This has the benefits described below. At first, when the gas discharge tube is subjected to surface-mounted reflow soldering by a user, since the protective layers have a small heat conductivity coefficient and cover the electrodes having a relatively large heat conductivity coefficient, external heat may be further prevented from being transferred to the low-temperature sealing adhesive, so as to prevent a failure, caused by a misoperation of open circuit, of the gas discharge tube during reflow soldering. Secondly, when the gas discharge tube is heated by a large current or a long-time overcurrent, since the protective layers have a small heat conductivity coefficient and cover the electrodes having a relatively large heat conductivity coefficient, a smaller part of heat inside the gas discharge tube is transferred to the outside, and the heat may be more intensively used to melt the low-temperature sealing adhesive, so that the gas discharge tube is enabled to have an open circuit quickly.

With reference to FIG. 8, an axially sectional view illustrating a gas discharge tube provided by Embodiment 8 of the present disclosure is shown. As shown in FIG. 8, the gas discharge tube 8 of the present embodiment includes: electrodes 81, an insulating tube body 82, a low-temperature sealing adhesive 83, a metal ring 84 and high-temperature solder layers 85. The insulating tube body 82 has an upper end and a lower end which are respectively connected in the sealing manner with the two electrodes 81. Specifically, the upper end of the insulating tube body 82 is connected in the sealing manner with the metal ring 84 through one high-temperature solder layer 85. The metal ring 84 is connected in the sealing manner with the electrode 81 through the low-temperature sealing adhesive 83. The lower port of the insulating tube body 82 is connected in sealing manner with the other electrode 81 through the other high-temperature solder layer 85.

Specifically, the metal ring 84 may be adapted to high-temperature sealing with the insulating tube body 82, and may also be adapted to low-temperature sealing with the electrode 81. In a preferred embodiment, the metal ring 84 is a ring made of non-oxidation copper. In another preferred embodiment, the surface, which is in contact with the low-temperature sealing adhesive 83, of the metal ring 84 is a rough surface. The rough surface causes a large adhesive force, so that the metal ring 84 may be adhered in the sealing manner with the low-temperature sealing adhesive 83 more firmly. In another preferred embodiment, the width of the cross sectional of the metal ring 84 is greater than the width of the cross sectional of the insulating tube body 82, so as to enlarge a contact area, namely the adhesion area, between the metal ring 84 and the low-temperature sealing adhesive 83, such that the metal ring 84 is adhered in the sealing manner with the low-temperature sealing adhesive 83 more firmly.

Preferably, a metalized layer (not shown), preferably a molybdenum and manganese layer, is arranged at the upper end of the insulating tube body 82. The metal ring 84 is connected in the sealing manner to the metalized layer of the insulating tube body 82 through a high-temperature solder, preferably a silver-copper solder.

The present embodiment has the advantages described below.

The metal ring is arranged at one end of the insulating tube body of the gas discharge tube of the present embodiment, and the end is sealed by using the low-temperature sealing adhesive. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive reaches the melt point and starts to be melted, and then the gas starts to leak from the discharge inner cavity, and external air enters the discharge inner cavity of the gas discharge tube, thereby quickly cutting off the circuit and protecting the circuit.

Figure 11:
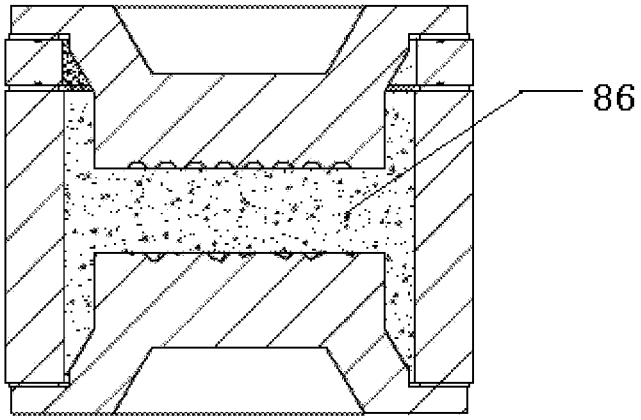
FIG. 11 is an axially sectional view illustrating a gas discharge tube according to a first preferred implementation provided by Embodiment 8 of the present disclosure.

The present embodiment also has five preferred implementations. FIG. 11 is an axially sectional view illustrating a gas discharge tube according to a first preferred implementation. With reference to FIG. 11, the gas discharge tube shown in FIG. 11 is the same as the gas discharge tube shown in FIG. 8 in the following aspects: electrodes, an insulating tube body, a low-temperature sealing adhesive, a metal ring and high-temperature solder layers. A difference from the gas discharge tube shown in FIG. 8 is that: the discharge inner cavity of the gas discharge tube shown in FIG. 11 is filled with insulating particulate matter 86. Preferably, the insulating particulate matter is quartz sand particles. This has the advantages described below. Since the discharge inner cavity is filled with the insulating particulate matter, heat generated by discharging of the discharge inner cavity is mostly absorbed by the insulating particulate matter. When a large current passes through the gas discharge tube, the electrodes at both ends of the discharge inner cavity may not have a sharp temperature rise that causes melting, explosion and sputtering, and there is more time for the low-temperature sealing adhesive to be melted, so that the open circuit protection for a circuit is enhanced. On the contrary, if no quartz sand is added, when the large current passes through the gas discharge tube, instantaneous discharging may generate extremely large quantity of heat which may possibly result in such a phenomenon that the electrode is melted, exploded and sputtered before the low-temperature sealing adhesive is melted and the gas leaks, thereby resulting in a short circuit.

FIG. 12 is an axially sectional view illustrating a gas discharge tube according to a second preferred implementation. With reference to FIG. 12, the gas discharge tube shown in FIG. 12 is the same as the gas discharge tube shown in FIG. 8 in the following aspects: electrodes, an insulating tube body, a low-temperature sealing adhesive, a metal ring and high-temperature solder layers. A difference from the gas discharge tube shown in FIG. 8 is that: the gas discharge tube shown in FIG. 12 further includes a spring apparatus 87. The spring apparatus 87 has a free end 871. The free end 871 is pressed into a retracted state by the electrode adhered with the low-temperature sealing adhesive. When the low-temperature sealing adhesive is melted, a counterforce of the free end 871 to the electrode is greater than an adhesive force between the electrode and the low-temperature sealing adhesive, so that the free end 871 extends to pull away the electrode adhered with the low-temperature sealing adhesive. Similarly, when both ends of the gas discharge tube are provided with the low-temperature sealing adhesive, the spring apparatus may be provided with two free ends (not shown). Any one of the free ends may extend to pull away the electrode at the end as long as the low-temperature sealing adhesive at the end is melted. This has the advantages described below. When a large current passes through the gas discharge tube, if the low-temperature sealing adhesive starts to be melted till the adhesive force between the low-temperature sealing adhesive and the electrode is reduced, the free end of the spring apparatus extends because the equilibrium between the counterforce and the adhesive force is broken, so as to quickly pull away the electrode adhered with the low-temperature sealing adhesive, resulting in quick gas leakage, which causes an open circuit, so as to further enhance the open circuit protection for a circuit. On the contrary, if no spring apparatus is provided, when the large current passes through the gas discharge tube, instantaneous discharging generates extremely large quantity of heat which may possibly cause such a phenomenon that the electrode is melted, exploded and sputtered before the low-temperature sealing adhesive is melted to leak gas, thereby resulting in a short circuit.

Figure 13:
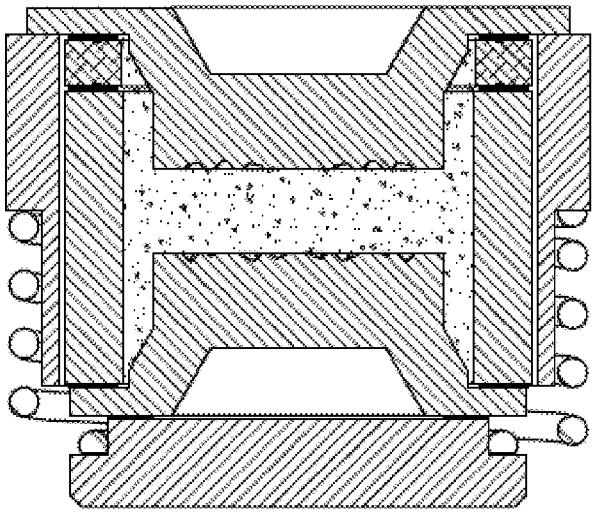
FIG. 13 is an axially sectional view illustrating a gas discharge tube according to a third preferred implementation provided by Embodiment 8 of the present disclosure.

FIG. 13 is an axially sectional view illustrating a gas discharge tube according to a third preferred implementation. With reference to FIG. 13, the gas discharge tube shown in FIG. 13 integrates the advantages of the gas discharge tubes shown in FIG. 11 and FIG. 12, i.e., the spring apparatus is arranged on the gas discharge tube, and the discharge inner cavity is filled with the insulating particulate matter, so as to further ensure that the gas discharge tube, through which a large current passes, may have an open circuit in time to realize dual protection for a circuit.

Figure 14:
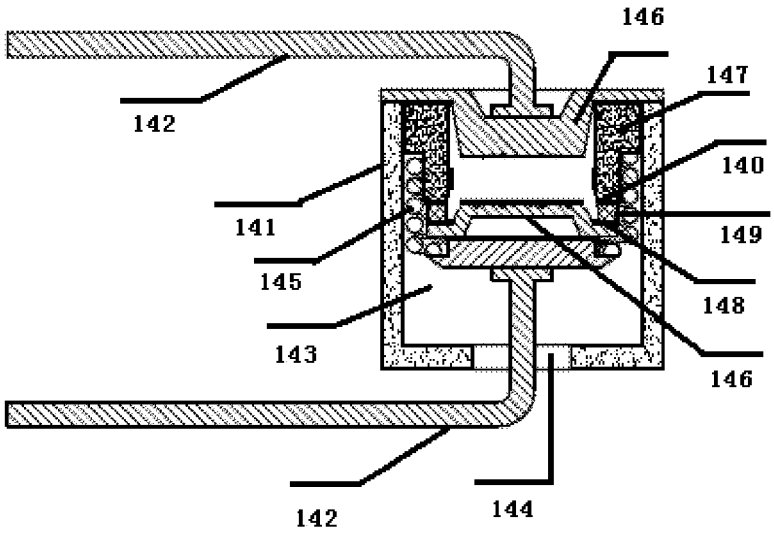
FIG. 14 is an axially sectional view illustrating a gas discharge tube according to a fourth preferred implementation provided by Embodiment 8 of the present disclosure.

FIG. 14 is an axially sectional view illustrating a gas discharge tube according to a fourth preferred implementation provided by Embodiment 8 of the present disclosure. With reference to FIG. 14, the gas discharge tube shown in FIG. 14 is the same as the gas discharge tube shown in FIG. 12 in the following aspects: a spring apparatus 145, electrodes 146, an insulating tube body 147, a low-temperature sealing adhesive 148, a metal ring 149 and high-temperature solder layers 140. A difference from the gas discharge tube shown in FIG. 12 is that: the gas discharge tube as shown in FIG. 14 includes pins 142 respectively connected with the two electrodes, and a shell 141 having a cavity 143 for accommodating the spring apparatus 145. The cavity 143 is further provided with a through hole 144 communicated with external air. One pin 142 extends out via the through hole 144. Preferably, the shell is a ceramic shell. This has the advantages described below. When a large current passes through the gas discharge tube, if the low-temperature sealing adhesive starts to be melted till the adhesive force between the low-temperature sealing adhesive and the electrode is reduced, the spring apparatus enables the free end to extend because the equilibrium between the counterforce and the adhesive force is broken, so as to quickly pull away the electrode adhered with the low-temperature sealing adhesive, resulting in quick gas leakage, which causes an open circuit. Meanwhile, the arranged shell prevents the parts which are possibly scattered from falling on the ground when the gas discharge tube is open.

Figure 15:
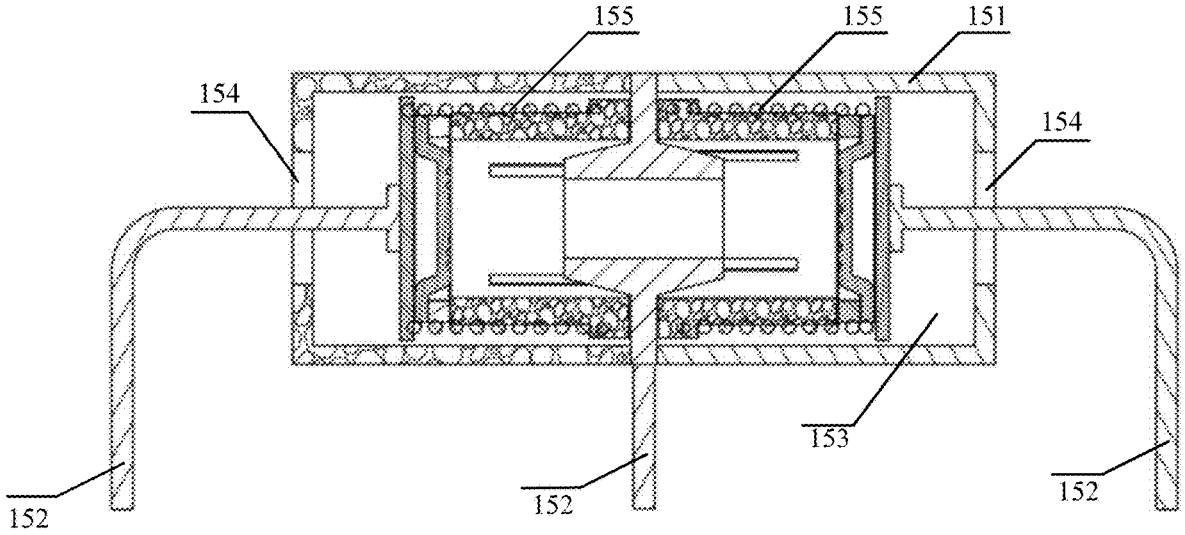
FIG. 15 is an axially sectional view illustrating a gas discharge tube according to a fifth preferred implementation provided by Embodiment 8 of the present disclosure.

FIG. 15 is an axially sectional view illustrating a gas discharge tube according to a fifth preferred implementation provided by Embodiment 8 of the present disclosure. With reference to FIG. 15, the gas discharge tube shown in FIG. 15 differs from the gas discharge tube according to the fourth preferred implementation shown in FIG. 14 is that: the gas discharge tube is a triode provided with two spring apparatuses 155, pins 152 are respectively connected with the three electrodes, and a shell 151 having a cavity 153 for accommodating the spring apparatuses 155. The cavity 153 is further provided with two through holes 154 communicated with external air. Two of the pins 152 extend out via the through holes 154. The advantages of this preferred implementation are the same as those of the preferred implementation shown in FIG. 14, so that no more details will be described herein.

Figure 9:
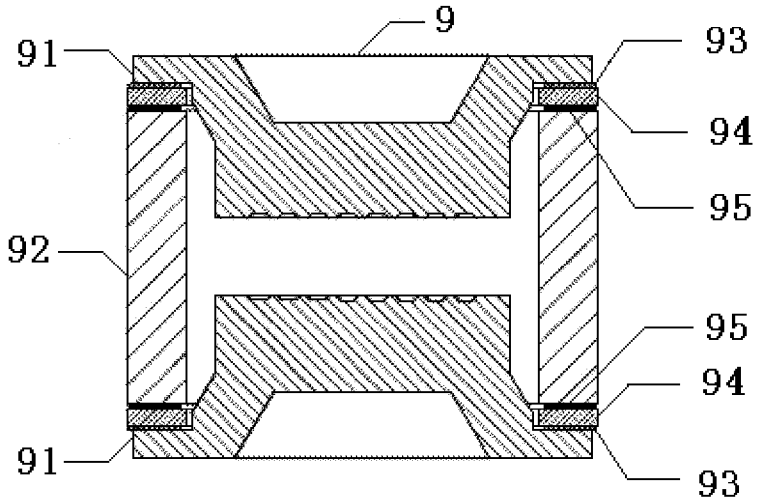
FIG. 9 is an axially sectional view illustrating a gas discharge tube provided by Embodiment 9 of the present disclosure.

With reference to FIG. 9, an axially sectional view illustrating a gas discharge tube provided by Embodiment 9 of the present disclosure is shown. The gas discharge tube 9 includes: an insulating tube body 92, electrodes 91, metal rings 94, low-temperature sealing adhesive 93 and high-temperature solder layers 95. The insulating tube body 92 has an upper end and a lower end which are respectively connected in the sealing manner with the metal rings 94 through the high-temperature solder layers 95. The metal rings 94 are connected in the sealing manner with the electrodes 91 through the low-temperature sealing adhesive 93.

It should be noted that except the features that "the lower end of the insulating tube body 92 is also provided with a metal ring 94 and is connected in the sealing manner with the metal ring 94 through the high-temperature solder layer 95, and the metal ring 94 is connected in the sealing manner with the electrode 91 through the low-temperature sealing adhesive 93", all other features of the present embodiment are the same as those of the embodiment shown in FIG. 8, and specifically refer to the embodiment shown in FIG. 8, so that no more details will be described herein. The each of two ends of the insulating tube body 92 is provided with a metal ring and the low-temperature sealing adhesive, so that when a temperature rise is caused by overcurrent heat, the gas discharge tube leaks gas more easily to cut off a circuit to further protect the circuit.

The present embodiment has the advantages described below.

In the gas discharge tube of the present embodiment, metal rings are arranged at the two ends of the insulating tube body, and the ends are sealed by using the low-temperature sealing adhesive. Therefore, the gas discharge tube can implement the overvoltage protection when undergoing a lightning overvoltage. Furthermore, when the gas discharge tube has a temperature rise to a specific temperature under a large current or a long-time overcurrent, the low-temperature sealing adhesive at any end reaches the melt point and starts to be melted, and then the gas starts to leak from the discharge inner cavity, and external air enters the discharge inner cavity of the gas discharge tube, thereby quickly cutting off the circuit and protecting the circuit.

Apparently, the above-mentioned embodiments are only to clearly describe examples taken, but not intended to limit the implementation. Some technical features in any one of the above-mentioned embodiments may also be applied to other embodiments. For example, the setting of the adhesion area between the insulating tube body and the electrodes, the arrangement of the leakage-prone points, the arrangement of the insulating particulate matter in the discharge inner cavity and the arrangement of the spring apparatus may be all applied into other embodiments. Those ordinarily skilled in the art can further make other changes or variations in different forms on the basis of the above-mentioned descriptions. It is unnecessary and impossible to exemplify all implementation modes herein. If only the low-temperature sealing adhesive is adopted to seal the discharging inner cavity, and the gas leakage occurs in the discharging inner cavity when the low-temperature sealing adhesive is melted at a specific low-temperature melt point, the gas discharge tube shall fall within the protection scope of the present application regardless of the way in which the low-temperature sealing adhesive is arranged which position in the gas discharge tube.

INDUSTRIAL PRACTICABILITY

The gas discharge tube of the present disclosure may be manufactured and used. Furthermore, when the gas discharge tube has the temperature rise to the specific temperature under a large current or the long-time overcurrent, the low-temperature sealing adhesive at any one of the ends reaches the melt point and starts to be melted, and then gas leaks from the discharge inner cavity, and external air enters the discharge inner cavity of the gas discharge tube, thereby quickly cutting off the circuit and protecting the circuit. The gas discharge tube has beneficial technical effects.

What is claimed is:

1. A gas discharge tube, comprising at least two electrodes, an insulating tube body and a low-temperature sealing adhesive, wherein the insulating tube body is connected in a sealing manner with the electrodes to form a discharge inner cavity, wherein the low-temperature sealing adhesive is used for sealing the discharge inner cavity, and the low-temperature sealing adhesive is melted at a specific low temperature to cause gas leakage in the discharge inner cavity, wherein the gas discharge tube further comprises a cover plate, wherein at least one electrode of the electrodes is provided with a radial ventilation hole, a groove is arranged in an outer surface of the at least one electrode, at least one end of the radial ventilation hole is connected with the discharge inner cavity, the radial ventilation hole penetrates through the groove, and the cover plate is connected to the outer surface of the electrode through the low-temperature sealing adhesive and is used for covering the groove;

or, wherein the gas discharge tube further comprises a cover plate, wherein the insulating tube body is provided with a ventilation hole, and the ventilation hole has an outer end connected with the cover plate through the low-temperature sealing adhesive;

or, wherein the insulating tube body is provided with a disconnection layer for dividing the insulating tube body into two sections along a radial direction, and the low-temperature sealing adhesive is arranged in the disconnection layer and is used for the two sections of the insulating tube body in the sealing manner;

or, wherein the gas discharge tube includes a middle electrode, the middle electrode is provided with a disconnection layer for dividing the middle electrode into two portions, and the low-temperature sealing adhesive is arranged in the disconnection layer and is used for connecting the two portions of the middle electrode in the sealing manner;

or, wherein at least one electrode of the electrodes is connected in the sealing manner with the insulating tube body through the low-temperature sealing adhesive.

2. The gas discharge tube according to claim 1, further comprising a cover plate, wherein at least one electrode of the electrodes is provided with an axial ventilation hole, the axial ventilation hole has an inner end connected with the discharge inner cavity, and an outer end is connected with the cover plate through the low-temperature sealing adhesive.

3. The gas discharge tube according to claim 1, wherein in the case where the at least one electrode of the electrodes is connected in the sealing manner with the insulating tube body through the low-temperature sealing adhesive, the gas discharge tube further comprises a metalized layer or a metal ring, wherein metalized layer or the metal ring is arranged between the electrode and the insulating tube body, and the electrode is connected in the sealing manner with the metalized layer or the metal ring through the low-temperature sealing adhesive.

4. The gas discharge tube according to claim 3, wherein the gas discharge tube further comprises a spring apparatus, the spring apparatus has at least one free end, and the free end is pressed into a retracted state by the electrode adhered with the low-temperature sealing adhesive; when the low-temperature sealing adhesive is melted, a counterforce of the free end to the electrode is greater than an adhesive force between the electrode and the low-temperature sealing adhesive, and the free end extends to pull away the electrode adhered with the low-temperature sealing adhesive.

5. The gas discharge tube according to claim 4, wherein the gas discharge tube further comprises a plurality of pins and a shell, the pins are connected with the electrodes respectively, the shell has a cavity for accommodating the spring apparatus, the cavity is further provided with a through hole communicated with external air, and at least one pin of the pins extends out via the through hole.

6. The gas discharge tube according to claim 1, wherein the low-temperature sealing adhesive has a specific shape, so that the low-temperature sealing adhesive meets a specific melting requirement.

7. The gas discharge tube according to claim 1, wherein at least one leakage-prone point is arranged in the electrodes or the low-temperature sealing adhesive or the insulating tube body, so that the low-temperature sealing adhesive is easier to melt at the leakage-prone point relative to other positions.

8. The gas discharge tube according to claim 1, wherein the discharge inner cavity is filled with insulating particulate matter.

9. The gas discharge tube according to claim 1, further comprising a protective layer having a heat conductivity coefficient less than the heat conductivity coefficient of the electrodes, wherein the protective layer is arranged on an outer surface in contact with the outside of the low-temperature sealing adhesive.

10. The gas discharge tube according to claim 9, wherein the protective layer is a nickel layer or a chromium layer.

11. The gas discharge tube according to claim 9, wherein the protective layer is a layer of metal.

12. The gas discharge tube according to claim 9, wherein the protective layer is a layer of non-metal.

* * * * *